US007370437B2

(12) United States Patent
Holtman

(10) Patent No.: US 7,370,437 B2
(45) Date of Patent: May 13, 2008

(54) SHEET HANDLING DEVICE WITH A PRINT SURFACE AND A FEED PLATE

(75) Inventor: Lodewiik T. Holtman, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 11/285,080

(22) Filed: Nov. 23, 2005

(65) Prior Publication Data

US 2006/0109489 A1 May 25, 2006

(30) Foreign Application Priority Data

Nov. 25, 2004 (EP) ..... 04106085

(51) Int. Cl.
*F26B 13/30* (2006.01)

(52) U.S. Cl. ..... 34/616; 34/620; 374/88; 374/104

(58) Field of Classification Search ..... 34/453, 34/92, 134, 126, 616, 620; 347/88, 104
See application file for complete search history.

(56) References Cited

U.S. PATENT DOCUMENTS 6,196,672 B1 * 3/2001 Ito et al. ..... 347/88
6,270,215 B1 * 8/2001 Miyasaka et al. ..... 347/104
6,739,775 B2 * 5/2004 Van Soest et al. ..... 400/579

FOREIGN PATENT DOCUMENTS

| | | |
|---|---|---|
| EP | 0 471 189 A1 | 7/1991 |
| EP | 0 729 841 A2 | 9/1996 |
| EP | 0 729 842 A3 | 9/1996 |
| EP | 1 123 809 A2 | 8/2001 |

* cited by examiner

*Primary Examiner*—S. Gravini
(74) *Attorney, Agent, or Firm*—Birch, Stewart, Kolasch & Birch, LLP

(57) ABSTRACT

A sheet handling device for a printer or copier which includes a print surface for supporting a first surface of a sheet, a feed plate having an edge adjacent to the print surface, and a feed mechanism for feeding the sheet to the print surface through a gap between the edge of the feed plate and the print surface, wherein the edge of the feed plate has notches arranged such that at the edge, the notches provide space for the sheet at a second surface of the sheet.

9 Claims, 1 Drawing Sheet

SHEET HANDLING DEVICE WITH A PRINT SURFACE AND A FEED PLATE

BACKGROUND OF THE INVENTION

The present invention relates to a sheet handling device for a printer or copier containing a print surface for supporting a first surface of a sheet, a feed plate having an edge being adjacent to the print surface, and a feed mechanism for feeding a sheet to the print surface through a gap between the edge of the feed plate and the print surface.

In printers in which paper sheets or similar image receiving sheets are used as recording media, a tendency of the paper to cockle may sometimes constitute a serious problem. The cockling phenomenon is related to the fact that paper and similar materials tend to absorb humidity from ambient air and to expand and contract in accordance with their humidity content. Typically, the expansion and contraction is not isotropic and is particularly pronounced in a direction in which the fibers of the paper are predominantly oriented. When there exists a gradient in humidity within the paper, then the more humid portion of the paper will expand more than the drier portion, which inevitably leads to the production of cockles or wrinkles.

Once cockles have developed in the paper during the transport of the paper towards the sheet support plate, a further expansion or contraction of the paper may lead to an expansion of the cockles, so that the height of the cockles also grows.

In a typical setup of an ink jet printer, especially a large format printer, the paper is intermittently advanced over a flat sheet support plate, while a carriage moves back and forth across the paper, and ink jet printheads mounted on the carriage are energized to eject droplets of ink onto the paper to form a printed image. Since the carriage moves with relatively high velocity, the ink droplets ejected onto the paper undergo a certain aberration and are deposited on the paper in a somewhat dislocated position. The amount of dislocation is proportional to the flight distance of the ink droplets. Thus, when cockles are present in the paper, the flight distance is non-uniform and, accordingly, the dislocation of the spots of ink on the paper also becomes non-uniform, so that the quality of the printed image becomes deteriorated. The larger the height of the cockles, the more pronounced is the deteriorating effect.

When the ink jet print printheads are positioned very close to the surface of the paper to minimize the dislocation, the printheads might even touch large cockles or bumps of the paper, so that the quality of the printed image is also deteriorated.

SUMMARY OF THE INVENTION

Accordingly, it is an object of the present invention to provide a sheet handling device which feeds a sheet to a print surface in basically a flat, low or not at all cockled configuration, and to provide a printer containing such sheet handling device.

According to the present invention, this object is achieved by a sheet handling device of the type indicated above, wherein the edge of the feed plate contains notches being arranged such that, at the edge, the notches provide space for the sheet at a second surface of the sheet.

The notches are separate from each other and are arranged to guide the sheet mainly at those parts of the edge that are between the notches. Thus, the notches govern the positions at which cockles or wrinkles develop. By adapting the size and the positions of the notches to the material and thickness of the sheets, to their tendency to produce cockles or wrinkles, and to the humidity gradients and temperatures that are to be expected, the notches may be arranged to favor certain smaller cockle sizes over larger cockle sizes.

At a conventional feed plate with an edge that forms a straight line, an expansion of the sheet material at a certain region of the sheet might lead to the development of a large bump. However, the feed plate of the present invention will regulate the forming of cockles, and the expansion of the material of the sheet will be distributed over several smaller bumps or cockles. Thus, the height of the cockles or bumps is considerably reduced.

Generally, the height of the cockles is related to their lateral extension. By reducing the lateral extension and thus the height of the cockles, the disadvantages of cockling mentioned above are reduced.

Preferably, the notches are arranged in a regular pattern, whereby the effect of the notches is uniformly distributed. For example, a repeat distance of the notches may be the same for all neighboring notches, so that a cockle size corresponding to the repeat distance is favored.

Preferably, the feed mechanism includes sheet transport rollers that are distributed over the width of the feed plate. For example, the sheet transport rollers are accommodated in slots of the feed plate.

In a preferred embodiment, the sheet transport rollers and the notches are positioned such that, at lateral positions of the sheet transport rollers, there is a larger distance between neighboring notches than an average distance. Thus, the flattening effect of the transport rollers is accounted for which suppress the occurrence of cockles at the positions of the transport rollers and thereby favors the development of cockles between the positions of the transport rollers.

For example, the distance between neighboring notches varies in a regular pattern. For example, the notches are grouped into pairs, each pair being arranged between the lateral positions of the transport rollers. Additionally or alternatively, the size and/or shape of the notches may vary in a regular pattern.

BRIEF DESCRIPTION OF THE DRAWINGS

A preferred embodiment of the present invention will now be described in conjunction with the drawings wherein.

DETAILED DESCRIPTION OF THE INVENTION

Figure 1:
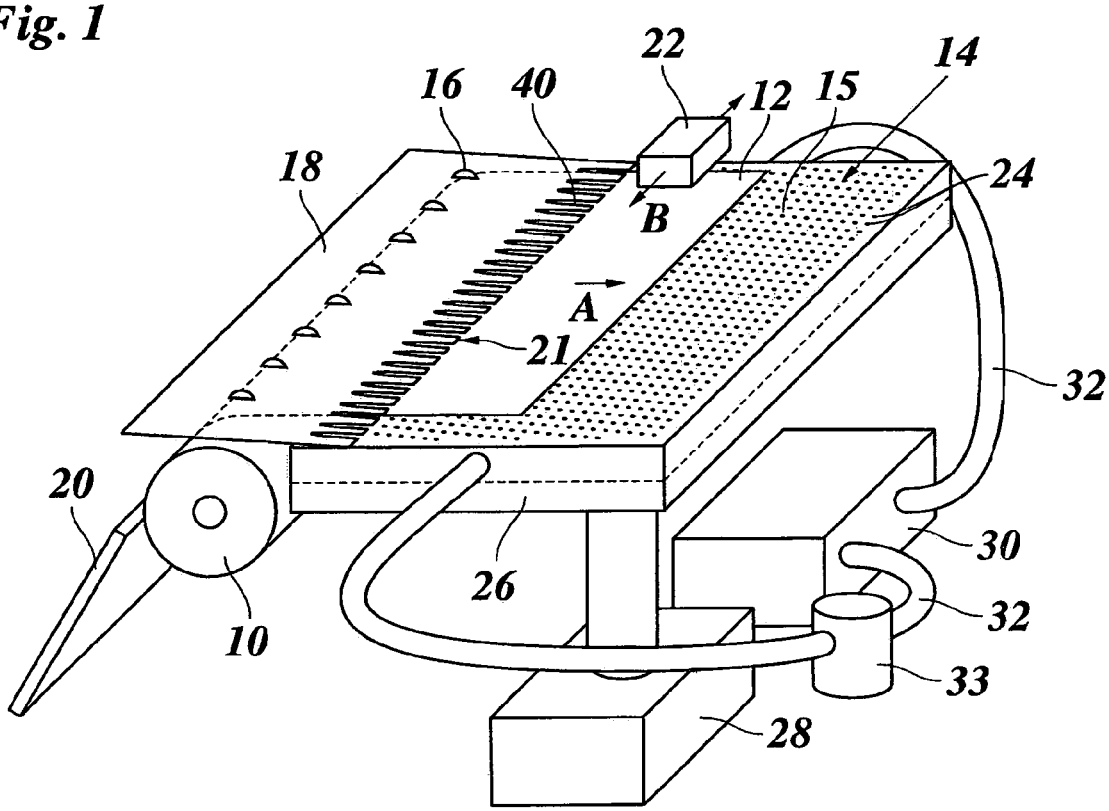
FIG. 1 is a schematic perspective view of a hot melt ink jet printer.

As is shown in FIG. 1, a hot melt ink jet printer includes a platen 10 which is intermittently driven to rotate in order to advance a sheet 12, e.g. a sheet of paper, in a direction indicated by an arrow A over the top surface of a sheet support plate 14, the top surface forming a print surface 15. A number of transport rollers 16 that are distributed over the width of the feed plate 18 are accommodated in slots 19 (FIG. 3) of the feed plate 18 and are rotatably supported in the feed plate 18. The transport rollers 16 intersect the feed plate 18 and form a transport nip with the platen 10, so that the sheet 12, which is supplied from a reel (not shown) via a guide plate 20, is transported along a sheet transport slot that is formed by the feed plate 18 and the print surface 15 of the sheet support plate 14. The sheet 12 is paid out through a gap formed between an edge 21 of the feed plate 18 and the surface of the sheet support plate 14. At the edge 21, the feed plate 18 forms an angle of, for example, less than 10° with the print surface 15.

A carriage 22 which includes a number of hot melt ink jet printheads (not shown) is mounted above the sheet support plate 14 so as to reciprocate in the direction of arrows B across the sheet 12. Thus, by energizing the printheads, a number of pixel lines of an image are printed in each pass of the carriage 22. Then, the sheet 12 is advanced by a step of appropriate length in the direction indicated by the arrow A, so that the next pixel lines can be printed.

The print surface 15 of the sheet support plate 14 has a regular pattern of suction holes 24 which pass through the plate and open into a suction chamber 26 that is formed in the lower part of the plate 14. The suction chamber is connected to a blower 28 which creates a subatmospheric pressure in the suction chamber, so that air is drawn-in through the suction holes 24. As a result, the sheet 12 is drawn against the flat surface of the support plate 14.

The sheet support plate 14 is temperature-controlled in order to control the cooling rate and the solidification of the hot melt ink that has been deposited on the paper. The sheet support plate 14 is temperature-controlled by means of a temperature control system 30 which circulates a temperature control fluid, preferably a liquid, through the plate 14. The temperature control system includes a circulating system with tubes 32 that are connected to opposite ends of the plate 14. One of the tubes passes through an expansion vessel 33 containing a gas buffer for absorbing temperature-dependent changes in the volume of the liquid. As will be readily understood, the temperature control system 30 includes heaters, temperature sensors, heat sinks, and the like for controlling the temperature of the fluid, as well as a pump or other displacement means for circulating the fluid through the interior of the sheet support plate 14.

On its way from the guide plate 20, past the platen 10 and past the feed plate 18 to the print surface 15, the sheet 12 will inevitably be exposed to ambient air and, as a result, will absorb humidity, especially when the relative humidity (RH) of the ambient air is high.

When the humidity content of the paper increases, it tends to expand, in particular in the direction in which the fibers in the paper are predominantly oriented. Typically, this is the direction transverse to the longitudinal direction of the web. When the sheet 16, after having expanded in this way, reaches, for example, the sheet support plate 14 and is, for example, heated to the temperature of the sheet support plate 14, part of the water contained in the paper will be evaporated, and the paper shrinks again in the width direction of the sheet. Thus, since a humidity gradient is present in the paper, the accompanying reduction in the width of the sheet leads to the production of cockles. This has been exaggeratedly illustrated in FIGS. 2 and 3.

Generally, when the sheet 12 comes into contact with the print surface 15, the sheet might be exposed to a different temperature or a different relative humidity of the ambient air at the sheet support plate 14. Thus, new cockles may develop, or those cockles which have already been present in the sheet may expand further.

To control the distribution and the development of the cockles in the sheet 12 in order to prevent larger cockles from existing, the feed plate 18 contains notches 40.

Figure 2:
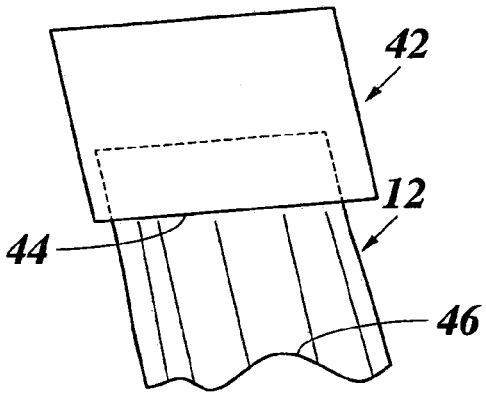
FIG. 2 is a schematic view of a paper sheet, illustrating the occurrence of large cockles after the sheet has been moved past an edge of a conventional feed plate.

As a comparative example, FIG. 2 shows a part of a conventional feed plate 42 having an edge 44 that forms a straight line. Large cockles or bumps 46 may occur in the sheet 12 that is to be printed.

Due to the notches 40 provided on the feed plate 18 of the present invention, the occurrence of large bumps 46 is prevented, and smaller cockles 48 (FIG. 3) are favored. This is due to the fact that the notches provide space for the sheet, so that the occurrence of small cockles 48 is favored at the positions of the notches 40.

Figure 3:
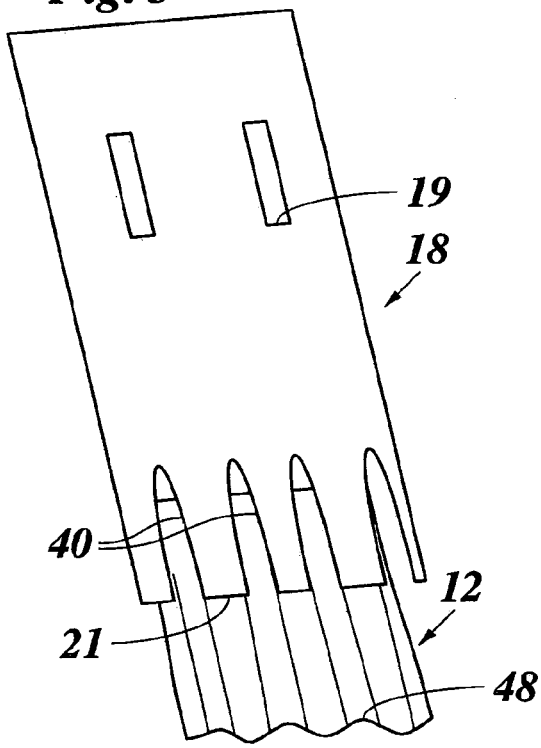
FIG. 3 is a schematic view of a paper sheet, illustrating the occurrence of smaller cockles after the sheet has passed an edge of a feed plate of the sheet handling device of FIG. 1.

As is shown in FIG. 1, the notches 40 are arranged in a regular pattern. However, as is shown in FIG. 3, a smaller distance and a larger distance between neighboring notches can be alternately provided. Thus, the notches 40 are grouped into pairs. Regarding the lateral positions of the slots 19 that accommodate the sheet transport rollers 16 (FIG. 1), the slots 19 are arranged in coincidence with the larger distance between the notches 40. Thus, each pair of notches 40 is arranged between the lateral positions of neighboring transport rollers 16.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet handling device which comprises:

a print surface for supporting a first surface of a sheet, a feed plate having an edge adjacent to the print surface and located at the side of the sheet opposite to the side on which the sheet is supported on the print surface, and a feed mechanism for feeding the sheet to the print surface through a gap defined by the edge of the feed plate and the print surface, said print surface containing suction holes for drawing the sheet against the print surface, wherein the edge of the feed plate contains a plurality of notches arranged such that, at said edge the notches provide space for the sheet at a second surface of the sheet.

2. The sheet handling device according to claim 1, wherein the notches are arranged in a regular pattern.

3. The sheet handling device according to claim 1, wherein the feed mechanism includes sheet transport rollers that extend over the width of the feed plate.

4. The sheet handling device according to claim 3, wherein the sheet transport rollers and the notches are positioned such that, at lateral positions of the sheet transport rollers, there is a larger distance between neighboring notches than an average distance.

5. The sheet handling device according to claim 1, wherein the print surface is formed by a sheet support plate containing a plurality of suction holes.

6. A printer containing the sheet handling device of claim 1.

7. The printer according to claim 6, said printer being a hot-melt ink jet printer.

8. The sheet handling device of claim 1, wherein the edge of the feed plate is located downstream of the first mechanism and upstream of the printhead.

9. A sheet handling device which comprises:

a print surface for supporting a first surface of a sheet, a feed plate having an edge adjacent to the print surface and located at the side of the sheet opposite to the side on which the sheet is supported on the print surface, and a feed mechanism for feeding the sheet to the print surface through a gap defined by the edge of the feed plate and the print surface, wherein the print surface is formed by a sheet support plate and wherein the edge of the feed plate contains a plurality of notches arranged such that, at said edge the notches provide space for the sheet at a second surface of the sheet.

* * * * *